US009677432B2

(12) United States Patent
Kang et al.

(10) Patent No.: US 9,677,432 B2
(45) Date of Patent: Jun. 13, 2017

(54) HYBRID POWER GENERATION SYSTEM AND METHOD USING SUPERCRITICAL $CO_2$ CYCLE

(71) Applicant: DOOSAN HEAVY INDUSTRIES & CONSTRUCTION CO., LTD., Changwon-si, Gyeongsangnam-do (KR)

(72) Inventors: Sung Gju Kang, Changwon-si (KR); Young Oon Kim, Changwon-si (KR); Hyung Keun Chi, Yongin-si (KR); Jeong Ho Hwang, Dalseo-gu (KR)

(73) Assignee: DOOSAN HEAVY INDUSTRIES & CONSTRUCTION CO., LTD., Changwon-si (KR)

( * ) Notice: Subject to any disclaimer, the term of this patent is extended or adjusted under 35 U.S.C. 154(b) by 58 days.

(21) Appl. No.: 14/797,991

(22) Filed: Jul. 13, 2015

(65) Prior Publication Data

US 2016/0010513 A1 Jan. 14, 2016

(30) Foreign Application Priority Data

Jul. 14, 2014 (KR) ..... 10-2014-0088571

(51) Int. Cl.
*F01K 25/10* (2006.01)
*F01K 11/02* (2006.01)
(Continued)

(52) U.S. Cl.
CPC ..... *F01K 25/10* (2013.01); *F01K 7/22* (2013.01); *F01K 7/32* (2013.01); *F01K 7/40* (2013.01);
(Continued)

(58) Field of Classification Search
CPC ..... F01K 25/10; F01K 23/00; F01K 11/02; F01K 13/006; F01K 7/40; F01K 7/22; F01K 25/103; F01K 7/32
(Continued)

(56) References Cited

U.S. PATENT DOCUMENTS 3,971,211 A * 7/1976 Wethe ..... F01K 7/32 60/39.181
2011/0179799 A1* 7/2011 Allam ..... F23M 5/085 60/772
(Continued)

FOREIGN PATENT DOCUMENTS

WO 2014194400 A1 12/2014

OTHER PUBLICATIONS

European Office Action in connection with Counterpart EP Application No. 15175871.1 dated Jan. 22, 2016.

*Primary Examiner* — Hoang Nguyen
(74) *Attorney, Agent, or Firm* — Sughrue Mion, PLLC

(57) ABSTRACT

A hybrid power generation system using a supercritical $CO_2$ cycle includes a steam power generation unit including a plurality of turbines driven with steam heated using heat generated by a boiler to produce electric power, and a supercritical $CO_2$ power generation unit including an S—$CO_2$ heater for heating a supercritical $CO_2$ fluid, a turbine driven by the supercritical $CO_2$ fluid, a precooler for lowering a temperature of the supercritical $CO_2$ fluid passing through the turbine, and a main compressor for pressurizing the supercritical $CO_2$ fluid, so as to produce electric power. The steam power generation unit and the supercritical $CO_2$ power generation unit share the boiler. The hybrid power generation system may improve both the power generation
(Continued)

efficiencies of the steam cycle and the supercritical $CO_2$ cycle by interconnecting the steam cycle and the supercritical $CO_2$ cycle.

20 Claims, 4 Drawing Sheets

(51) Int. Cl.

| | |
|---|---|
| ***F01K 7/22*** | (2006.01) |
| ***F01K 7/32*** | (2006.01) |
| ***F01K 7/40*** | (2006.01) |
| ***F01K 13/00*** | (2006.01) |
| ***F01K 23/00*** | (2006.01) |

(52) U.S. Cl.
CPC ..... *F01K 11/02* (2013.01); *F01K 13/006* (2013.01); *F01K 23/00* (2013.01); *F01K 25/103* (2013.01)

(58) Field of Classification Search
USPC ..... 60/650, 653–654, 677–680, 682–684
See application file for complete search history.

(56) References Cited

U.S. PATENT DOCUMENTS

| | | | | |
|---|---|---|---|---|
| 2013/0133327 | A1* | 5/2013 | Milam | F01K 25/08 60/651 |
| 2013/0145759 | A1 | 6/2013 | Sonwane et al. | |
| 2015/0376801 | A1* | 12/2015 | Bairamijamal | B01D 53/002 204/257 |

* cited by examiner

HYBRID POWER GENERATION SYSTEM AND METHOD USING SUPERCRITICAL $CO_2$ CYCLE

CROSS-REFERENCE(S) TO RELATED APPLICATIONS

This application claims priority to Korean Patent Application No. 10-2014-0088571, filed on Jul. 14, 2014, the disclosure of which is incorporated herein by reference in its entirety.

BACKGROUND OF THE INVENTION

Field of the Invention

Exemplary embodiments of the present invention relate to a hybrid power generation system using a supercritical $CO_2$ cycle, and more particularly, to a hybrid power generation system using a supercritical $CO_2$ cycle, which realizes optimal efficiency by applying a supercritical $CO_2$ cycle to a steam cycle as a bottom cycle.

Description of the Related Art

A need to efficiently produce electric power is gradually increased since Korea significantly depends on imported energy sources and constantly suffers from a severe electric power shortage every summer and winter. Moreover, various efforts have been performed in order to reduce generation of pollutants and increase electric power production since activities for reducing generation of pollutants are internationally increased. One of them is a study on a power generation system using supercritical $CO_2$, which utilizes supercritical carbon dioxide as a working fluid, as disclosed in Korean Patent Laid-Open Publication No. 2013-0036180.

The supercritical carbon dioxide simultaneously has a density similar to that of liquid and a viscosity similar to that of gas, thereby enabling the system to be miniaturized and the electric power required for compression and circulation of the fluid to be minimally consumed. In addition, it is easy to handle the supercritical carbon dioxide since the supercritical carbon dioxide has a smaller critical point of 31.4° C. and 72.8 atmospheres, compared to water having a critical point of 373.95° C. and 217.7 atmospheres. When the power generation system using supercritical $CO_2$ is operated at the temperature of 550° C., the system may have about 45% of net power generation efficiency, which is an improved power generation efficiency of 20% or more, compared to an existing steam cycle and the size of a turbo device may be reduced to one several tenth. In addition, the power generation system using supercritical $CO_2$ is mostly operated as a closed cycle which does not discharge the carbon dioxide used for power generation to the outside, thereby significantly contributing to a reduction of pollutant discharge for each country.

However, since it is difficult for the existing power generation system using supercritical $CO_2$ to have a large size more than a certain magnitude, the system may supply only a portion of necessary electric power. In addition, there is a need to efficiently increase electric power production and reduce discharge of pollutants in a coal-fired thermal power generation system.

Accordingly, in order to resolve these problems, there is a need to improve the power generation system using supercritical $CO_2$ and the coal-fired thermal power generation system and to efficiently enhance electric power production.

RELATED ART DOCUMENT

[Patent Document] Korean Patent Laid-Open Publication No. 2013-0036180 (Apr. 11, 2013)

SUMMARY OF THE INVENTION

An object of the present invention is to provide a hybrid power generation system using a supercritical $CO_2$ cycle, which realizes optimal efficiency by applying a supercritical $CO_2$ cycle to a steam cycle as a bottom cycle.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a hybrid power generation system using a supercritical $CO_2$ cycle includes a steam power generation unit including a plurality of turbines driven with steam heated by a boiler to produce electric power, and a supercritical $CO_2$ power generation unit including an S—$CO_2$ heater for heating a supercritical $CO_2$ fluid, a turbine driven by the supercritical $CO_2$ fluid, a precooler for lowering a temperature of the supercritical $CO_2$ fluid passing through the turbine, and a main compressor for pressurizing the supercritical $CO_2$ fluid, so as to produce electric power, wherein the steam power generation unit and the supercritical $CO_2$ power generation unit share the boiler.

The steam power generation unit may further include a plurality of feed water heaters for reheating the steam driving the turbines, a plurality of outside air injectors for supplying outside air to the boiler, a gas air heater (GAH) for recovering waste heat from combustion gas discharged after burning by the boiler, and an exhaust gas ejector for discharging exhaust gas passing through the gas air heater.

The supercritical $CO_2$ power generation unit may further include a recompressor driven by the supercritical $CO_2$ fluid branched before introduction into the precooler, a first high-recuperator installed between the turbine and the recompressor, and a second low-recuperator installed between the recompressor and the main compressor.

The S—$CO_2$ heater may be installed in the boiler.

The boiler may further include a steam superheater for superheating the steam and a steam reheater for reheating the steam supplied from the turbine, and the S—$CO_2$ heater may be installed in a front end part of the steam superheater and the steam reheater.

The supercritical $CO_2$ power generation unit may further include an S—$CO_2$ gas cooler for recovering waste heat from the exhaust gas between the gas air heater and the exhaust gas ejector.

The S—$CO_2$ gas cooler may be connected to the second low-recuperator and the first high-recuperator, and the supercritical $CO_2$ fluid may be compressed by the main compressor, be exchanged with heat by the S—$CO_2$ gas cooler via the second low-recuperator, and then be introduced into the first high-recuperator.

The supercritical $CO_2$ power generation unit may further include an air preheater for recovering waste heat from the precooler, and the air preheater may be connected to the outside air injectors and the gas air heater.

The supercritical $CO_2$ power generation unit may further include an S—$CO_2$ feed water heater connected to one of the feed water heaters so as to heat the supercritical $CO_2$ fluid passing through the second low-recuperator using heat recovered from the feed water heater.

The S—$CO_2$ feed water heater may have an outlet end connected to the precooler so that the supercritical CO2 fluid passing through the S—$CO_2$ feed water heater is introduced into the precooler.

The supercritical $CO_2$ power generation unit may further include an S—$CO_2$ air heater provided between the gas air heater and the air preheater so as to be connected to the gas air heater and the air preheater.

The S—$CO_2$ air heater may be connected to the first high-recuperator and the second low-recuperator, and heat outside air passing through the air preheater.

In accordance with another aspect of the present invention, a hybrid power generation method using a supercritical $CO_2$ cycle includes a steam cycle for producing electric power by a steam power generation unit and a supercritical $CO_2$ cycle for producing electric power by a supercritical $CO_2$ power generation unit, wherein the supercritical $CO_2$ cycle includes performing fluid heating in which a supercritical $CO_2$ fluid is heated using an S—$CO_2$ heater of the supercritical $CO_2$ power generation unit provided in a boiler of the steam power generation unit, performing turbine driving in which a turbine is driven by the heated supercritical $CO_2$ fluid, performing first heat exchange in which the supercritical $CO_2$ fluid passing through the turbine is exchanged with heat by a first high-recuperator, performing second heat exchange in which the supercritical $CO_2$ fluid exchanged with heat by the first high-recuperator is exchanged with heat by a second low-recuperator , performing cooling in which the supercritical $CO_2$ fluid after the performing second heat exchange is cooled by a precooler, performing compression in which the supercritical $CO_2$ fluid cooled through the performing cooling is supplied to and compressed by a main compressor, performing third heating in which the compressed supercritical $CO_2$ fluid is heated via the second low-recuperator, performing fourth heating in which the supercritical $CO_2$ fluid passing through the second low-recuperator is heated via the first high-recuperator, and performing circulation in which the supercritical $CO_2$ fluid after the performing fourth heating is circulated to the S—$CO_2$ heater.

The supercritical $CO_2$ cycle may further include performing recovery cooling, in which the supercritical $CO_2$ fluid after the performing second heat exchange is introduced into an S—$CO_2$ feed water heater to be cooled by recovering heat from a feed water heater of the steam power generation unit, between the performing second heat exchange and the performing cooling.

The supercritical $CO_2$ cycle may further include performing auxiliary heating, in which the supercritical $CO_2$ fluid after the performing third heating is heated via an S—$CO_2$ gas cooler for recovering waste heat from exhaust gas discharged from the boiler and then proceeds to the performing fourth heating, between the performing third heating and the performing fourth heating.

The supercritical $CO_2$ cycle may further include performing recompressor driving, in which a portion of the supercritical $CO_2$ fluid introduced into the S—$CO_2$ feed water heater is branched to drive a recompressor, between the performing second heating and the performing recovery cooling.

The steam cycle includes performing preheating in which outside air used to burn fuel is heated by recovering waste heat from the precooler through an air preheater installed at the precooler, performing combustion in which fuel is injected and burned in the boiler, performing turbine driving in which steam is heated with heat generated through the performing combustion and drives a plurality of turbines, and performing exhaust gas discharge in which combustion gas generated by the boiler is discharged to the outside.

The steam cycle may further include performing heat recovery, in which waste heat is recovered from the exhaust gas by the S—$CO_2$ gas cooler, prior to the performing exhaust gas discharge.

The steam cycle may further include performing additional heating, in which the outside air after the performing preheating is additionally heated by an S—$CO_2$ air heater, between the performing preheating and the performing combustion.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
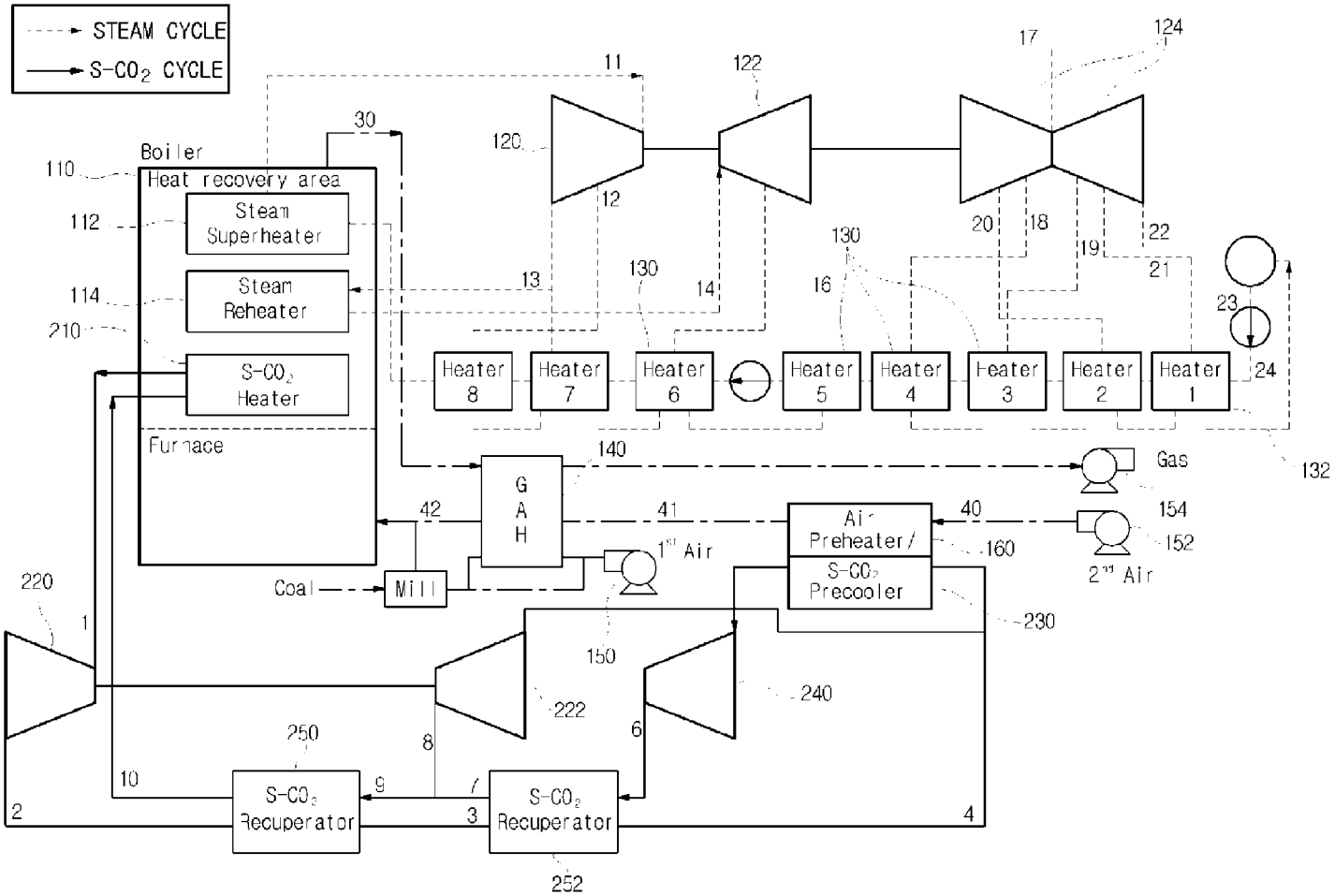
FIG. 1 is a block diagram illustrating a hybrid power generation system using a supercritical $CO_2$ cycle according to a first embodiment of the present invention.

A hybrid power generation system using a supercritical $CO_2$ cycle according to exemplary embodiments of the present invention will be described below in more detail with reference to the accompanying drawings. For the sake of convenience, like reference numerals will refer to like components throughout the various figures and embodiments of the present invention, and redundant description thereof will be omitted. In addition, inlet and outlet ends through which fluids are introduced into or discharged from the respective components and pipes connecting the components will be designated by reference numerals, and only respective points required to describe the embodiments of the present invention will be described using reference numerals.

A hybrid power generation system using a supercritical $CO_2$ cycle according to the present invention is a hybrid power generation system capable of improving both efficiencies of two power generation system by means of using a coal-fired thermal power generation system as a bottom cycle and using a power generation system using supercritical $CO_2$ as a topping cycle.

First, the bottom cycle according to the exemplary embodiments of the present invention will be described with reference to FIGS. 1 to 3.

The bottom cycle of the present invention is a steam cycle in which fossil fuel such as coal are supplied to and burned in a boiler 110 and water is converted into steam through supply of thermal energy generated by the boiler 110 to a steam generator (not shown). The steam is supplied to a first turbine 120 and a second turbine 122 through a steam pipe. After the first and second turbines 120 and 122 are operated, the steam is reheated by a plurality of feed water heaters 130 to be supplied to a third turbine 124, and is then cooled by a steam condenser (not shown) to be recovered as water again. Air used to burn the fossil fuel is supplied from the outside of the steam cycle. The supplied outside air is used to burn the fuel and is then discharged to the outside of the cycle after a portion of waste heat is recovered from the outside air.

Hereinafter, a steam power generation unit including each component constituting the above-mentioned steam cycle will be described.

The boiler 110 is provided with a steam superheater 112 which makes the steam supplied from the feed water heaters 130 as superheated steam and a steam reheater 114 which reheats the steam supplied from the first turbine 120. The combustion gas burned by the boiler 110 passes through a gas air heater (GAH) 140 and is then discharged to the outside of the system by an exhaust gas ejector 154 after waste heat is recovered from the combustion gas. Outside air introduced from the outside to burn the fuel by the boiler 110 is preheated and supplied while passing through the gas air heater 140. The outside air may be introduced through a plurality of paths. The present invention proposes an example in which a first outside air injector 150 and a second outside air injector 152 are used to supply the outside air to the steam cycle.

FIG. 1 is a block diagram illustrating a hybrid power generation system using a supercritical $CO_2$ cycle according to a first embodiment of the present invention.

As shown in FIG. 1, the hybrid power generation system using a supercritical $CO_2$ cycle according to the first embodiment of the present invention is a hybrid power generation system configured of the above-mentioned steam cycle and a supercritical $CO_2$ cycle, and the two cycles share the boiler 110.

That is, the boiler 110 of the steam power generation unit is provided with a supercritical $CO_2$ heater (hereinafter, referred to as "S—$CO_2$ heater") 210 which is a component of a supercritical $CO_2$ unit, so that a supercritical $CO_2$ fluid passes through the boiler 110 and is circulated in the supercritical $CO_2$ cycle.

The supercritical $CO_2$ unit according to the first embodiment of the present invention includes an S—$CO_2$ heater 210 which heats the high-pressure supercritical $CO_2$ fluid as a working fluid to an optimal process temperature, a turbine 220 which is driven by the supercritical $CO_2$ fluid passing through the S—$CO_2$ heater 210, a precooler 230 which lowers a temperature of the high-temperature and low-pressure supercritical $CO_2$ fluid passing through the turbine 220, and a main compressor 240 which pressurizes the low-temperature and low-pressure supercritical $CO_2$ fluid to 200 atmospheres or more. In addition, the supercritical $CO_2$ cycle may further include a recompressor 222 which is driven by the low-temperature and low-pressure supercritical $CO_2$ fluid branched before introduction into the precooler 230, and a first high-recuperator 250 and a second low-recuperator 252 which are respectively installed between the turbine 220 and the recompressor 222 and between the recompressor 222 and the main compressor 240. Here, the high or low temperature in the present invention means only a relatively high or low temperature in connection with other points in the cycle, and does not mean an absolute temperature value. The above components form a closed cycle. Since the supercritical $CO_2$ fluid is circulated in the closed cycle, the closed cycle is referred to as a supercritical $CO_2$ cycle.

The first high-recuperator 250 serves to lower the temperature of the supercritical $CO_2$ fluid discharged from the turbine 220 and raise the temperature of the supercritical $CO_2$ fluid introduced into the S—$CO_2$ heater 210, through heat exchange. Similarly, the second low-recuperator 252 also serves to lower the temperature of the supercritical $CO_2$ fluid introduced into the main compressor 240 and raise the temperature of the supercritical CO2 fluid discharged from the main compressor 240, through heat exchange.

Thus, the supercritical $CO_2$ fluid from the S—$CO_2$ heater 210 to an inlet end of the second low-recuperator 252 (1~3) is in a high-temperature state (is a high-temperature), and the supercritical $CO_2$ fluid from an outlet end of the second low-recuperator 252 to the main compressor 240 (4~5) is in a relatively low-temperature state (is a low-temperature fluid). In addition, the supercritical $CO_2$ fluid from an outlet end of the main compressor 240 to an inlet end of the first high-recuperator 250 (6~9) is in a low-temperature state (is a low-temperature fluid), and the supercritical $CO_2$ fluid from an outlet end of the first high-recuperator 250 to an inlet end of the S—$CO_2$ heater 210 (10) is in a relatively high-temperature state (is a high-temperature fluid).

Recompression efficiency of the supercritical $CO_2$ cycle may be improved in such a manner that a portion of the supercritical $CO_2$ fluid before introduction into the precooler 230 is branched to the recompressor 222.

The S—$CO_2$ heater 210 is preferably installed in a high-temperature part in the boiler 110. In a case in which the S—$CO_2$ heater 210 is used alone, heat discarded from the precooler 230 is decreased as a recompression ratio is increased while the supercritical $CO_2$ fluid is circulated in the cycle. Consequently, the efficiency of the system is increased. However, when the recompression ratio exceeds a certain ratio, the inlet end 10 of the turbine 220 has a higher temperature than the outlet end 2 of the turbine 220 and thus it is in a state in which the heat is transferred from the low temperature to the high temperature. For this reason, since the supercritical $CO_2$ fluid is impossible to be normally circulated, the system may not be normally maintained. Thus, when the S—$CO_2$ heater 210 is installed in the high-temperature part in the boiler 110, the temperature of the outlet end 2 of the turbine 220 is always maintained to be higher than that of the inlet end 10. Therefore, the supercritical $CO_2$ cycle may be normally maintained even though the recompression ratio is increased.

In addition, since a cementation phenomenon in which carbon dioxide reacts with metal and carbon is penetrated into the metal is generated in the supercritical $CO_2$ cycle, the pipe should be made of a high-quality material such as nickel. However, such a disadvantage acts as an advantage in the hybrid power generation system using a supercritical $CO_2$ cycle since the temperature of the supercritical $CO_2$ fluid may be set to be higher than a steam temperature in the steam cycle.

In more detail, heat transfer in the boiler 110 is subject to external heat transfer. Accordingly, entropy according to heat transfer is increased as a temperature difference between a fluid and a wall through which the fluid flows is increased. Therefore, the entropy is decreased by decreasing the temperature difference between the fluid and the wall through which the fluid flows, thereby enabling the efficiency of the power generation system to be enhanced.

When the S—$CO_2$ heater 210 is installed in a front end part, which is a position before the steam superheater 112 of the boiler 110 is installed, namely, in the high-temperature part, the supercritical $CO_2$ fluid circulated to the S—$CO_2$ heater 210 has a higher temperature than the steam supplied to the high-temperature part of the boiler 110. Therefore, the temperature of the steam may be increased by a temperature increase in the vicinity of the steam pipe. Consequently, a temperature difference between high-temperature exhaust gas and the steam circulated through the steam pipe may be reduced, and thus an entropy loss to the inlet of the first turbine 120 may be reduced so as to improve the efficiency of the power generation system.

That is, it may be possible to improve both the efficiencies of the steam cycle and the supercritical $CO_2$ cycle by installing the S—$CO_2$ heater 210 in the high-temperature part in the boiler 110.

Meanwhile, an air preheater 160 may be mounted to the precooler 230. The precooler 230 serves to lower the temperature of the supercritical $CO_2$ fluid introduced into the main compressor 240 to reduce a load of the main compressor 240, so as to improve compression efficiency thereof. Therefore, when the supercritical $CO_2$ cycle is configured alone, heat discarded from the precooler 230 is discharged, as it is, to the outside of the cycle. However, since the air preheater 160 is mounted to the precooler 230 in the present invention, the precooler 230 may recover and use waste heat for outside air preheating in the steam cycle. Thus, the steam cycle may have high efficiency by means of using the waste heat discarded from the precooler 230.

Although an example in which the air preheater is mounted to the precooler in the first embodiment of the present invention has been described, the precooler may also be mounted to a first feed water heater 132 of the steam cycle without provision of the air preheater.

Figure 2:
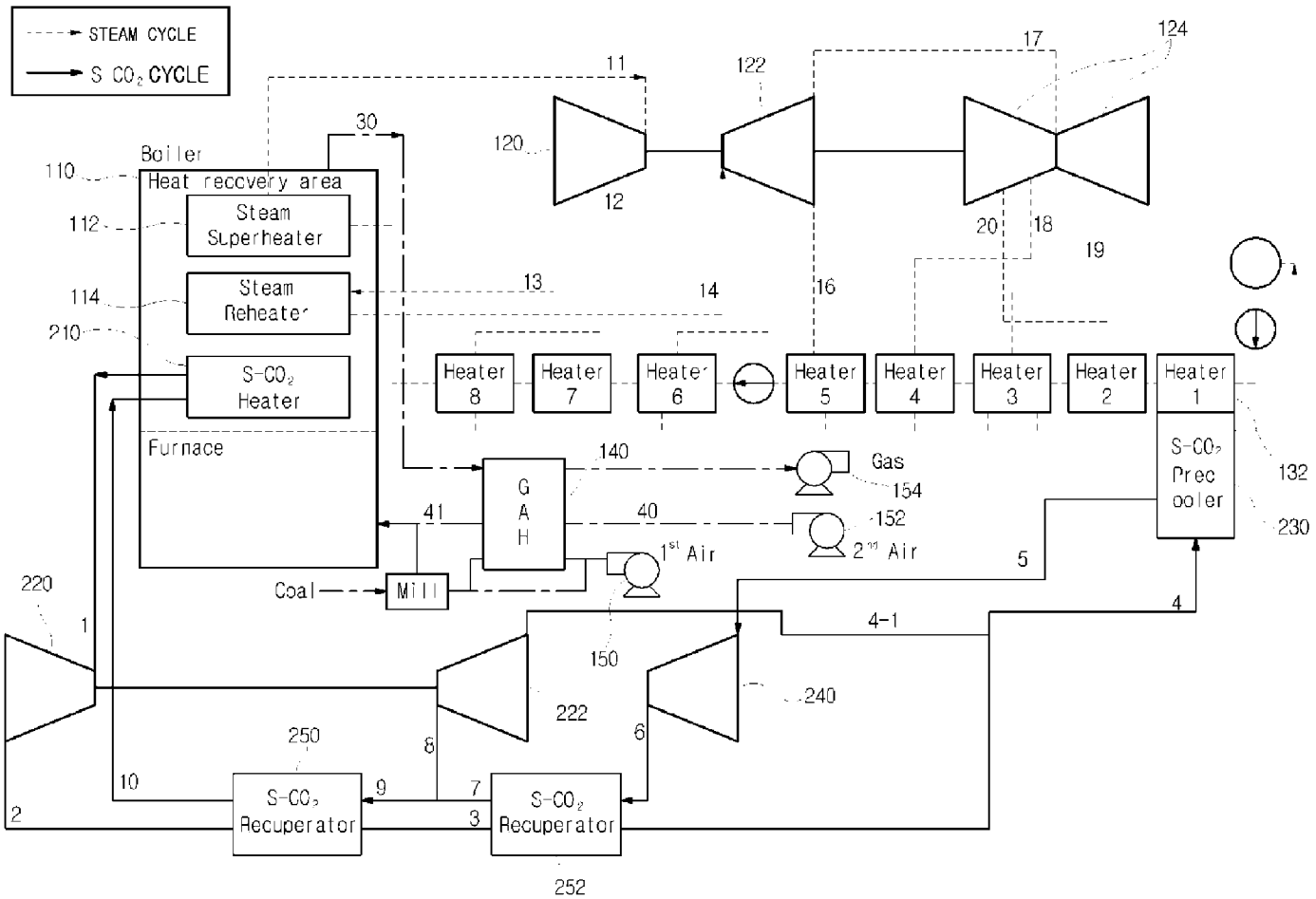
FIG. 2 is a block diagram illustrating a hybrid power generation system using a supercritical $CO_2$ cycle according to a second embodiment of the present invention.

FIG. 2 is a block diagram illustrating a hybrid power generation system using a supercritical $CO_2$ cycle according to a second embodiment of the present invention.

As shown in FIG. 2, in the hybrid power generation system using a supercritical $CO_2$ cycle according to the second embodiment of the present invention, a precooler 230 may be mounted to the first feed water heater 132 of the steam power generation unit. The waste heat is recovered from the precooler 230 by the first feed water heater 132 to be used in the steam cycle, and the supercritical $CO_2$ fluid passing through the precooler 230 is cooled and supplied to a main compressor 240.

However, since there is a limit to a waste heat capacity of the precooler 230 capable of being recovered by the air preheater 160 of the first embodiment or the first feed water heater 132 of the second embodiment, remaining waste heat should be entirely discharged from the precooler 230 when the waste heat is left at a ratio equal to or greater than a certain capacity. When the waste heat discharged from the precooler 230 has a ratio equal to or greater than a certain capacity, a heat transfer area is separately added to the steam condenser (not shown). In this case, since a power generation ratio of the supercritical $CO_2$ cycle having relatively high efficiency is increased even though cost is added, the entire efficiency of the hybrid power generation system is increased.

A third embodiment of the present invention is an optimal embodiment capable of maximizing efficiencies of the steam cycle and the supercritical $CO_2$ cycle compared to the first and second embodiments, and detailed description thereof will be given as follows.

Figure 3:
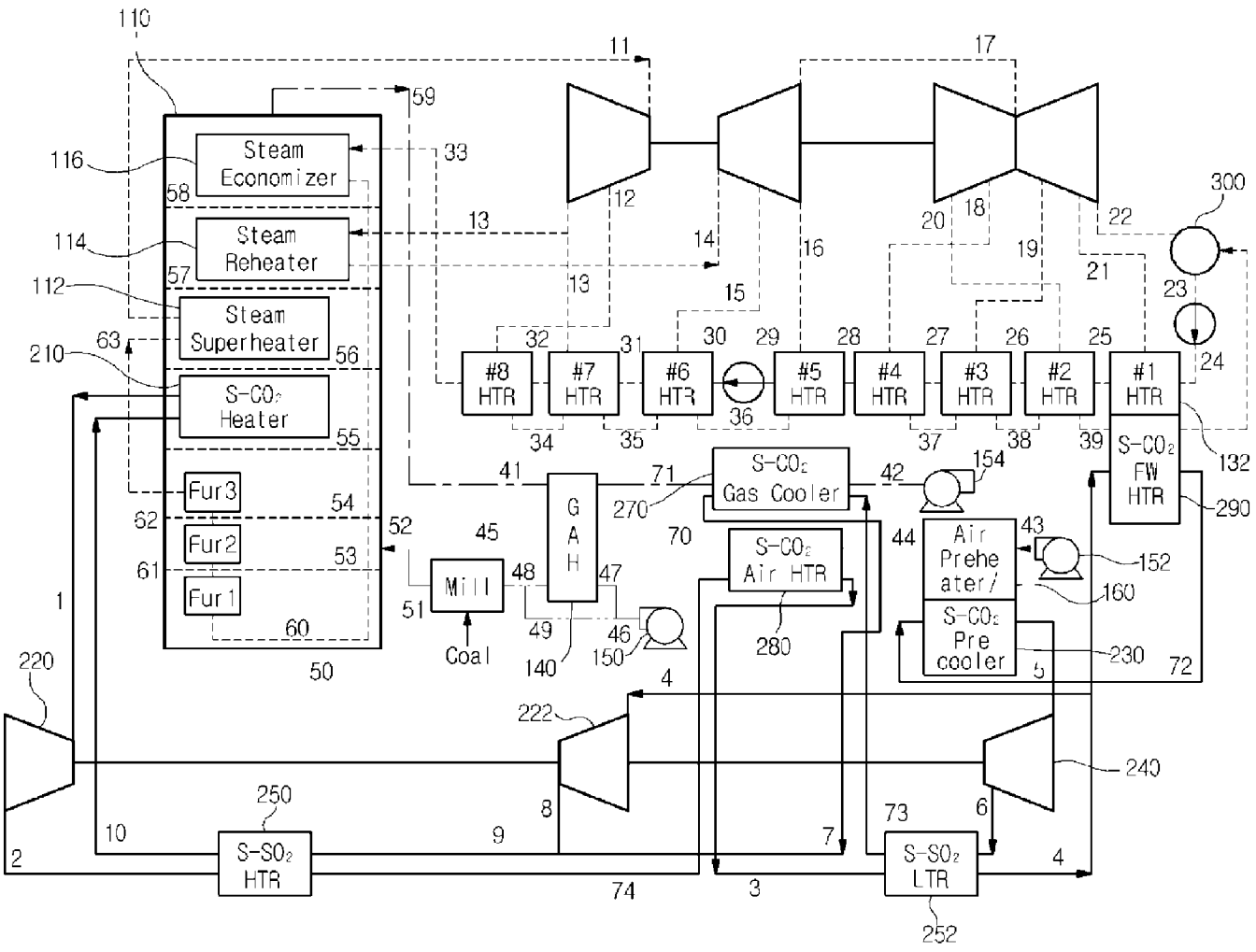
FIG. 3 is a block diagram illustrating a hybrid power generation system using a supercritical $CO_2$ cycle according to a third embodiment of the present invention.

FIG. 3 is a block diagram illustrating a hybrid power generation system using a supercritical $CO_2$ cycle according to the third embodiment of the present invention.

As shown in FIG. 3, the second outside air injector 152 of the steam power generation unit is provided with a precooler 230 and an air preheater 160, and the first feed water heater 132 of the steam power generation unit is provided with an S—$CO_2$ feed water heater 290 connected to an outlet end 4 of a second low-recuperator 252 of the supercritical $CO_2$ cycle. The outlet end 71 of the gas air heater 140 of the steam cycle is provided with an S—$CO_2$ gas cooler 270, and an S—$CO_2$ air heater 280 is provided between the air preheater 160 and the gas air heater 140.

The high-temperature supercritical $CO_2$ fluid, which is circulated to the S—$CO_2$ heater 210 installed in the boiler 110 of the steam cycle, drives the turbine 220, and is then discharged, exchanges heat with outside air introduced through the air preheater 160 while passing through the S—$CO_2$ air heater 280 via a first high-recuperator 250, and is then introduced into the second low-recuperator 252. The low-temperature and low-pressure supercritical $CO_2$ fluid passing through the second low-recuperator 252 is introduced and reheated in the S—$CO_2$ feed water heater 290, is cooled while passing through the precooler 230, and is then supplied to the main compressor 240. The supercritical $CO_2$ fluid compressed to high pressure by the main compressor 240 is heated again via the second low-recuperator 252 and the first high-recuperator 250, and is then introduced into the S—$CO_2$ heater 210 to be heated at high temperature.

Since heat discarded from the precooler 230 has a low temperature and the steam cycle is a small cooling cycle, a capacity ratio of heat capable of being recovered is low. Therefore, a heat transfer area should be separately added to a steam condenser 300 when the heat has a ratio equal to or greater than about 15% of capacity of the steam cycle. Thus, an S—$CO_2$ capacity ratio should be calculated in consideration of economic feasibility. However, when the separate heat transfer area is added to the steam condenser 300, the steam cycle should be arranged such that heat is maximally recovered in consideration of relative fluid conditions between the S—$CO_2$ feed water heater 290 and the precooler 230. FIG. 3 shows an arrangement example in which an inlet air temperature of the precooler 230 is lower than an inlet feed water temperature of the S—$CO_2$ feed water heater 290. In this case, when the supercritical $CO_2$ fluid which is primarily cooled through the S—$CO_2$ feed water heater 290 is supplied to the precooler 230, the temperature of the supercritical $CO_2$ fluid may be more efficiently lowered. On the other hand, when the inlet air temperature of the precooler 230 is higher than the inlet feed water temperature of the S—$CO_2$ feed water heater 290, it is preferable that the supercritical $CO_2$ fluid first passes through the precooler 230.

The supercritical $CO_2$ fluid compressed to low-temperature and high-pressure by the main compressor 240 is introduced into the S—$CO_2$ gas cooler 270 via the second low-recuperator 252.

When high moisture coal is used and burned in the boiler 110, a heat absorption ratio is decreased while a gas temperature in the boiler 110 is decreased and thus exhaust gas at the discharge end 59 of the boiler 110 has increased sensible heat. However, the sensible heat is sufficiently absorbed since the heat transfer area is limited. For this reason, since the temperature of the discharged exhaust gas is rather increased in spite of decrease of temperature in the boiler 110, a phenomenon in which the efficiency of the boiler 110 is reduced is generated. The supercritical $CO_2$ fluid is preheated in a process of heating the supercritical $CO_2$ fluid to high temperature by recovering the sensible heat of the discharged exhaust gas through the S—$CO_2$ gas cooler 270. Consequently, the first high-recuperator 250 may have a reduced load, and the temperature of the exhaust gas discharged from the boiler 110 for burning high moisture coal may be prevented from increasing.

Figure 4:
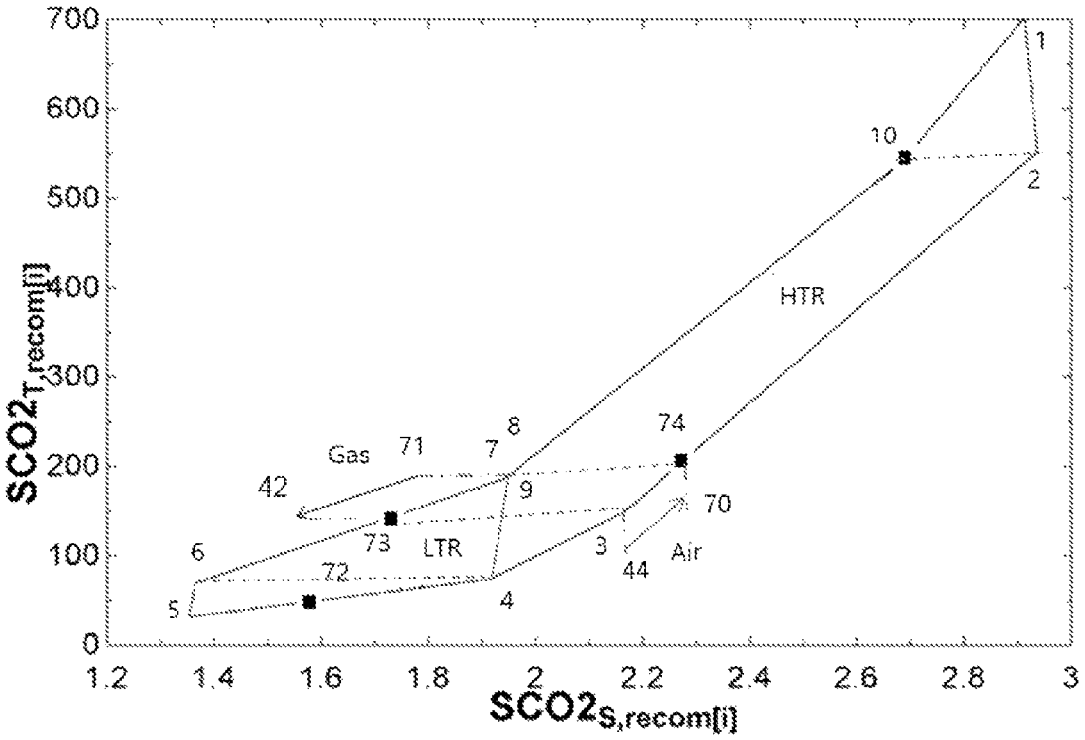
FIG. 4 is a graph illustrating a T-S relation in the hybrid power generation system according to the third embodiment of the present invention.

FIG. 4 is a graph illustrating a T-S relation in the hybrid power generation system according to the third embodiment of the present invention.

As shown in FIG. 4, in the relation of a temperature T and a specific heat capacity S of the supercritical $CO_2$ fluid, it may be seen that a temperature difference between a low-temperature fluid and a high-temperature fluid is properly maintained at 5 to 10° C. in the first high-recuperator 250 and the second low-recuperator 252 in the hybrid power generation system according to the present invention. Thus, it may be possible to maximize the efficiencies of the first high-recuperator 250 and the second low-recuperator 252 and to prevent an excess increase of the heat transfer area.

In addition, an existing section (points from 73 to 7) in which heating is impossible since the high-temperature fluid has a low temperature may be heated using exhaust gas discharged from the boiler 110, namely, heat of exhaust gas may be recovered from the S—$CO_2$ gas cooler 270. Thus, as shown in FIG. 4, it may be seen that the temperature of the exhaust gas is lowered from 200° C. to 143° C. and the temperature difference is properly maintained. It may be possible to exclude a risk of low-temperature corrosion since the temperature of the exhaust gas is maintained at a temperature equal to or greater than an acid dew point, In FIG. 4, it may be seen that waste heat discarded from the precooler 230 is supplied to the boiler 110 through the air preheater 160 and is used to burn fuel (points from 44 to 70).

As described above, the hybrid power generation system using a supercritical $CO_2$ cycle according to the embodiments of the present invention constitutes an optimal system by interconnecting the steam cycle and the supercritical $CO_2$ cycle, thereby improving both the efficiencies of the steam cycle and the supercritical $CO_2$ cycle.

A hybrid power generation method according to a fluid flow in the hybrid power generation system using a supercritical $CO_2$ cycle according to the embodiments of the present invention having the above-mentioned configuration will be described with reference to FIGS. 3 and 4. For convenience's sake, the method will be described on the basis of the third embodiment including concepts of all embodiments, and points of the fluid flow corresponding to respective steps will be described using reference numerals.

First, the method will be described on the basis of a supercritical $CO_2$ cycle (see FIG. 4 with respect to a temperature for each point).

The supercritical $CO_2$ cycle heats a high-pressure supercritical $CO_2$ fluid using an S—$CO_2$ heater 210 of a supercritical $CO_2$ power generation unit provided in a boiler 110 of a steam power generation unit (fluid heating step, 1). The heated supercritical $CO_2$ fluid is supplied to a turbine 220 and drives the turbine 220 (turbine driving step, 2).

The supercritical $CO_2$ fluid passing through the turbine 220 is exchanged with heat by a first high-recuperator 250 to be cooled (first heat exchange step, 2→74). In this case, the supercritical $CO_2$ fluid having a temperature reaching about 500° C. is lowered to have a temperature of about 200° C. through the first heat exchange step.

The heat-exchanged supercritical $CO_2$ fluid by the first high-recuperator 250 is exchanged with heat by a second low-recuperator 252 and is lowered to have a temperature of about 70° C. (second heat exchange step, 3→4). The supercritical $CO_2$ fluid after performing of the second heat exchange step is introduced into an S—$CO_2$ feed water heater 290 and is cooled by recovering heat of a first feed water heater 132 of the steam power generation unit (recovery cooling step, 4→72). Next, the supercritical $CO_2$ fluid is cooled to have a temperature equal to or less than 50° C. through a precooler 230 (cooling step, 72→5).

The supercritical $CO_2$ fluid cooled through the cooling step is supplied to a main compressor 240 to be compressed to high pressure (compression step, 5→6), and the compressed supercritical $CO_2$ fluid is heated to a temperature of about 140° C. via the second low-recuperator 252 (third heating step, 6→73). The supercritical $CO_2$ fluid passing through the second low-recuperator 252 is heated to a temperature of about 550° C. via the first high-recuperator 250 (fourth heating step, 9→10), and the supercritical $CO_2$ fluid after performing of the fourth heating step is circulated back to S—$CO_2$ heater 210 to be heated to a temperature of about 700° C. (circulation step, 10→1).

Meanwhile, between the third heating step and the fourth heating step, the supercritical $CO_2$ fluid after performing of the third heating step is heated via an S—$CO_2$ gas cooler 270 for recovering waste heat from exhaust gas discharged from the boiler 110, and then may proceed to the fourth heating step (auxiliary heating step, 73→7). Before the supercritical $CO_2$ fluid after performing of the second heating step is introduced into the S—$CO_2$ feed water heater 290, a portion of the supercritical $CO_2$ fluid to be introduced thereinto is branched and drives a recompressor 222 (recompression step, 4-1→8). As a result, the supercritical $CO_2$ cycle may have improved efficiency through a regeneration effect. A heat transfer area may not be separately added to an S—$CO_2$ condenser as a flow rate passing through the recompressor is increased, and thus an S—$CO_2$ capacity ratio may be increased.

Next, the method will be described on the basis of a steam cycle. The temperature for each point will be described with reference to FIG. 4, and detailed configurations in the boiler previously described in the above embodiments and detailed description of the general fluid flow in the steam cycle will be omitted.

The steam cycle heats outside air used to burn fuel by recovering waste heat from the precooler 230 through the air preheater 160 installed at the precooler 230 of the supercritical $CO_2$ cycle (preheating step, 43→44). The fuel is injected and burned in the boiler 110 together with the heated outside air (combustion step, 52), and steam is heated with heat generated through the combustion step and drives a plurality of turbines 120, 122, and 124 so as to produce electric power (turbine driving step, 11→17). The combustion gas generated by the boiler 110 is discharged to the outside (exhaust gas discharge step, 42).

However, prior to the exhaust gas discharge step, waste heat may be recovered from the exhaust gas by the S—$CO_2$ gas cooler 270 (heat recovery step, 71→42). In addition, between the preheating step and the combustion step, the outside air after performing of the preheating step may be additionally heated by an S—$CO_2$ air heater 280 to be supplied to the boiler 110 (additional heating step, 44→70).

Through such a method, the hybrid power generation system interconnecting the steam cycle and the supercritical $CO_2$ cycle may be efficiently operated.

As is apparent from the above description, a hybrid power generation system using a supercritical $CO_2$ cycle according to an embodiment of the present invention has an effect of improving both of power generation efficiencies of a steam cycle and a supercritical $CO_2$ cycle by interconnecting the steam cycle and the supercritical $CO_2$ cycle.

In addition, since the two cycles share a boiler, a temperature difference between a high-temperature fluid and a low-temperature fluid in the supercritical $CO_2$ cycle can be decreased by circulation of a supercritical $CO_2$ fluid having a high temperature, thereby improving the supercritical $CO_2$ cycle and a loss in a main compressor.

Furthermore, since the two cycles share the boiler and a supercritical $CO_2$ heater is operated at a higher temperature than steam, it may be possible to reduce an energy loss generated when heat is transferred from combustion gas having a high temperature to a steam pipe having a low temperature in the boiler of the steam cycle.

While the present invention has been described with respect to the specific embodiments, it will be apparent to those skilled in the art that various changes and modifications may be made without departing from the spirit and scope of the invention as defined in the following claims.

What is claimed is:

1. A hybrid power generation system using a supercritical $CO_2$ cycle, comprising:

a steam power generation unit comprising a plurality of turbines driven with steam heated by a boiler to produce electric power; and a supercritical $CO_2$ power generation unit comprising an S—$CO_2$ heater for heating a supercritical $CO_2$ fluid, a turbine driven by the supercritical $CO_2$ fluid, a precooler for lowering a temperature of the supercritical $CO_2$ fluid passing through the turbine, and a main compressor for pressurizing the supercritical $CO_2$ fluid, so as to produce electric power, wherein the steam power generation unit and the supercritical $CO_2$ power generation unit share the boiler.

2. The hybrid power generation system according to claim 1, wherein the steam power generation unit further comprises a plurality of feed water heaters for reheating the steam driving the turbines, a plurality of outside air injectors for supplying outside air to the boiler, a gas air heater (GAH) for recovering waste heat from combustion gas discharged after burning by the boiler, and an exhaust gas ejector for discharging exhaust gas passing through the gas air heater.

3. The hybrid power generation system according to claim 2, wherein the supercritical $CO_2$ power generation unit further comprises a recompressor driven by the supercritical $CO_2$ fluid branched before introduction into the precooler, a first high-recuperator installed between the turbine and the recompressor, and a second low-recuperator installed between the recompressor and the main compressor.

4. The hybrid power generation system according to claim 1, wherein the S—$CO_2$ heater is installed in the boiler.

5. The hybrid power generation system according to claim 4, wherein the boiler further comprises a steam superheater for superheating the steam and a steam reheater for reheating the steam supplied from the turbine, and the S—$CO_2$ heater is installed in a front end part of the steam superheater and the steam reheater.

6. The hybrid power generation system according to claim 3, wherein the supercritical $CO_2$ power generation unit further comprises an S—$CO_2$ gas cooler for recovering waste heat from the exhaust gas between the gas air heater and the exhaust gas ejector.

7. The hybrid power generation system according to claim 6, wherein the S—$CO_2$ gas cooler is connected to the second low-recuperator and the first high-recuperator, and the supercritical $CO_2$ fluid is compressed by the main compressor, is exchanged with heat by the S—$CO_2$ gas cooler via the second low-recuperator, and is then introduced into the first high-recuperator.

8. The hybrid power generation system according to claim 3, wherein the supercritical $CO_2$ power generation unit further comprises an air preheater for recovering waste heat from the precooler, and the air preheater is connected to the outside air injectors and the gas air heater.

9. The hybrid power generation system according to claim 8, wherein the supercritical $CO_2$ power generation unit further comprises an S—$CO_2$ feed water heater connected to one of the feed water heaters so as to heat the supercritical $CO_2$ fluid passing through the second low-recuperator using heat recovered from the feed water heater.

10. The hybrid power generation system according to claim 9, wherein the S—$CO_2$ feed water heater has an outlet end connected to the precooler so that the supercritical $CO_2$ fluid passing through the S—$CO_2$ feed water heater is introduced into the precooler.

11. The hybrid power generation system according to claim 8, wherein the supercritical $CO_2$ power generation unit further comprises an S—$CO_2$ air heater provided between the gas air heater and the air preheater so as to be connected to the gas air heater and the air preheater.

12. The hybrid power generation system according to claim 11, wherein the S—$CO_2$ air heater is connected to the first high-recuperator and the second low-recuperator, and heats outside air passing through the air preheater.

13. A hybrid power generation method using a supercritical $CO_2$ cycle, comprising:

a steam cycle for producing electric power by a steam power generation unit and a supercritical $CO_2$ cycle for producing electric power by a supercritical $CO_2$ power generation unit, wherein the supercritical $CO_2$ cycle comprises:

performing fluid heating in which a supercritical $CO_2$ fluid is heated using an S—$CO_2$ heater of the supercritical $CO_2$ power generation unit provided in a boiler of the steam power generation unit;

performing turbine driving in which a turbine is driven by the heated supercritical $CO_2$ fluid;

performing first heat exchange in which the supercritical $CO_2$ fluid passing through the turbine is exchanged with heat by a first high-recuperator;

performing second heat exchange in which the supercritical $CO_2$ fluid exchanged with heat by the first high-recuperator is exchanged with heat by a second low-recuperator;

performing cooling in which the supercritical $CO_2$ fluid after the performing second heat exchange is cooled by a precooler;

performing compression in which the supercritical $CO_2$ fluid cooled through the performing cooling is supplied to and compressed by a main compressor;

performing third heating in which the compressed supercritical $CO_2$ fluid is heated via the second low-recuperator;

performing fourth heating in which the supercritical $CO_2$ fluid passing through the second low-recuperator is heated via the first high-recuperator; and performing circulation in which the supercritical $CO_2$ fluid after the performing fourth heating is circulated to the S—$CO_2$ heater.

14. The hybrid power generation method according to claim 13, wherein the supercritical $CO_2$ cycle further comprises performing recovery cooling, in which the supercritical $CO_2$ fluid after the performing second heat exchange is introduced into an S—$CO_2$ feed water heater to be cooled by recovering heat from a feed water heater of the steam power generation unit, between the performing second heat exchange and the performing cooling.

15. The hybrid power generation method according to claim 13, wherein the supercritical $CO_2$ cycle further comprises performing auxiliary heating, in which the supercritical $CO_2$ fluid after the performing third heating is heated via an S—$CO_2$ gas cooler for recovering waste heat from exhaust gas discharged from the boiler and then proceeds to the performing fourth heating, between the performing third heating and the performing fourth heating.

16. The hybrid power generation method according to claim 14, wherein the supercritical $CO_2$ cycle further comprises performing recompressor driving, in which a portion of the supercritical $CO_2$ fluid introduced into the S—$CO_2$ feed water heater is branched to drive a recompressor, between the performing second heating and the performing recovery cooling.

17. The hybrid power generation method according to claim 13, wherein the steam cycle comprises:

performing preheating in which outside air used to burn fuel is heated by recovering waste heat from the precooler through an air preheater installed at the precooler;

performing combustion in which fuel is injected and burned in the boiler;

performing turbine driving in which steam is heated with heat generated through the performing combustion and drives a plurality of turbines; and performing exhaust gas discharge in which combustion gas generated by the boiler is discharged to the outside.

18. The hybrid power generation method according to claim 17, wherein the steam cycle further comprises performing heat recovery, in which waste heat is recovered from the exhaust gas by the S—$CO_2$ gas cooler, prior to the performing exhaust gas discharge.

19. The hybrid power generation method according to claim 17, wherein the steam cycle further comprises performing additional heating, in which the outside air after the performing preheating is additionally heated by an S—$CO_2$ air heater, between the performing preheating and the performing combustion.

20. A hybrid power generation system, comprising:

a steam power generation unit comprising:

a boiler;

a plurality of turbines driven with steam heated by the boiler to produce electric power;

a steam superheater disposed in the boiler for superheating the steam; and a steam reheater disposed in the boiler for reheating the steam supplied from the turbine; and a supercritical $CO_2$power generation unit comprising:

a S—$CO_2$ heater disposed in the boiler and configured to heat a supercritical $CO_2$ fluid, a turbine driven by the supercritical $CO_2$ fluid, a precooler configured to lower a temperature of the supercritical $CO_2$ fluid passing through the turbine, and a main compressor configured to pressurize the supercritical $CO_2$ fluid, so as to produce electric power, wherein the steam power generation unit and the supercritical $CO_2$ power generation unit share the boiler so that the supercritical $CO_2$ fluid passes through the boiler and is circulated in a supercritical $CO_2$ cycle.

* * * * *